US005580648A

United States Patent [19]

Castle et al.

[11] Patent Number: 5,580,648

[45] Date of Patent: Dec. 3, 1996

[54] REINFORCEMENT SYSTEM FOR MASTIC INTUMESCENT FIRE PROTECTION COATINGS

[75] Inventors: George K. Castle, Hollis, N.H.; John J. Gaffney, North Chelmsford, Mass.

[73] Assignee: AVCO Corporation, Providence, R.I.

[21] Appl. No.: 482,549

[22] Filed: Jun. 7, 1995

Related U.S. Application Data

[63] Continuation of Ser. No. 983,877, Dec. 1, 1992, abandoned.

[51] Int. Cl.[6] ..... B32B 7/00

[52] U.S. Cl. ..... 428/247; 428/255; 428/921

[58] Field of Search ..... 428/247, 255, 428/921

[56] References Cited

U.S. PATENT DOCUMENTS

| | | | |
|---|---|---|---|
| 739,646 | 9/1903 | Carter | 52/513 |
| 1,014,416 | 1/1912 | Schweikert | 52/513 |
| 1,988,081 | 1/1935 | Kemper | 72/109 |
| 2,143,261 | 1/1939 | Dickmann | 187/3 |
| 2,148,281 | 2/1939 | Scott | 72/16 |
| 2,213,603 | 9/1940 | Young et al. | 73/70 |
| 2,218,965 | 10/1940 | Young | 52/144 |

(List continued on next page.)

FOREIGN PATENT DOCUMENTS

| | | |
|---|---|---|
| 592353 | 1/1987 | Australia . |
| 2009794 | 9/1990 | Canada . |
| 066979A | 12/1982 | European Pat. Off. . |
| 276175A | 7/1988 | European Pat. Off. . |
| 310354 | 4/1989 | European Pat. Off. . |
| 511017A | 10/1992 | European Pat. Off. . |
| 1312849 | 11/1962 | France . |
| 2296502 | 7/1976 | France . |
| 2628507 | 9/1989 | France . |
| 444757 | 5/1927 | Germany . |
| 1808187 | 11/1968 | Germany . |
| 3115786 | 11/1982 | Germany . |
| 3906524 | 9/1990 | Germany . |
| 60-015148 | 1/1985 | Japan . |
| 01260021 | 10/1989 | Japan . |
| 4226342 | 8/1992 | Japan . |

(List continued on next page.)

OTHER PUBLICATIONS

*Refrasil® Advertisment,* Industrial Heating, Nov., 1992, p. 17.

Zola, J. C., "High Heat–and Flame–Resistant Mastics", in *Fire Retard Paints, Advances in Chemistry Series,* No. 9, Amer. Chem. Soc., Washington DC, 1954.

"Mesh Reinforcement–A must for Monolithic Fireproofing Systems" Textron Specialty Materials, Technical Service Bulletin (1988).

"Pitt–Char™ Fire Protective Coating" Pittsburgh Paints, Technical Data Bulletin (Apr. 1984).

Underwriters Laboratories, "Fire Resistance Index" (Jan. 1976).

"Pitt–Char™ Fire Protective Coating—The Coating that sets the New Standard for Hydrocarbon Fire Protection" Pittsburgh Paints (Apr. 1984).

"FIREC® Total System–British Evolved Developed and Manufactured" Advanced Fireproofing Systems, Ltd. Technical Service Bulletin (Undated).

"FIREC® Total System–The World's Foremost Epoxy Composite Lightweight Fire Resisting Intumescent Coatings" Advanced Fireproofing Systems, Ltd., Tech. Data Bul. (Undated).

(List continued on next page.)

*Primary Examiner*—Christopher Raimund
*Attorney, Agent, or Firm*—Scott Alexander McNeil

[57] ABSTRACT

A reinforcement system for mastic intumescent fire protection coatings. Free floating carbon mesh embedded in the coating is used to reinforce the coating. Optionally, the carbon mesh may be used in conjunction with mechanically attached reinforcements.

3 Claims, 2 Drawing Sheets

U.S. PATENT DOCUMENTS

| | | | |
|---|---|---|---|
| 3,320,087 | 5/1967 | Erickson | 117/137 |
| 3,516,213 | 6/1970 | Sauer | 52/725 |
| 3,872,636 | 3/1975 | Nicosia | 52/364 |
| 3,913,290 | 10/1975 | Billings et al. | 52/347 |
| 3,915,777 | 10/1975 | Kaplan | 156/202 |
| 3,960,626 | 6/1976 | Casadevall | 156/93 |
| 4,069,075 | 1/1978 | Billing et al. | 156/82 |
| 4,133,928 | 1/1979 | Riley et al. | 428/255 |
| 4,160,073 | 7/1979 | Lloyd-Lucas et al. | 521/122 |
| 4,198,493 | 4/1980 | Marciandi | 525/164 |
| 4,276,332 | 6/1981 | Castle | 428/36 |
| 4,276,342 | 6/1981 | Johnson | 428/247 |
| 4,284,834 | 8/1981 | Austin et al. | 585/25 |
| 4,414,674 | 11/1983 | Woodruff et al. | 373/130 |
| 4,517,782 | 5/1985 | Shamszadeh | 52/309.7 |
| 4,529,467 | 7/1985 | Ward | 156/307.3 |
| 4,690,851 | 9/1987 | Auduc | 428/116 |
| 4,700,518 | 10/1987 | Akihama et al. | 52/309.16 |
| 4,729,916 | 3/1988 | Feldman | 428/182 |
| 4,735,841 | 4/1988 | Sourdet | 428/116 |
| 4,804,299 | 2/1989 | Forte et al. | 405/285 |
| 4,835,046 | 5/1989 | Auduc | 428/288 |
| 4,936,064 | 6/1990 | Gibb | 52/232 |
| 5,145,734 | 9/1992 | Ito et al. | 428/229 |

FOREIGN PATENT DOCUMENTS

| | | |
|---|---|---|
| 7706793 | 12/1978 | Netherlands . |
| 130856 | 3/1929 | Switzerland . |
| 19262 | of 1909 | United Kingdom . |
| 832805 | 4/1960 | United Kingdom . |
| 879383 | 10/1961 | United Kingdom . |
| 904796 | 8/1962 | United Kingdom . |
| 956060 | 4/1964 | United Kingdom . |
| 973692 | 10/1964 | United Kingdom . |
| 1084503 | 9/1967 | United Kingdom . |
| 1358853 | 7/1974 | United Kingdom . |
| 1378752 | 12/1974 | United Kingdom . |
| 1387141 | 3/1975 | United Kingdom . |
| 1413016 | 11/1975 | United Kingdom . |
| 1439282 | 6/1976 | United Kingdom . |
| 1575708 | 9/1980 | United Kingdom . |
| 2097433 | 11/1982 | United Kingdom . |
| 2120580 | 12/1983 | United Kingdom . |
| 2191115 | 12/1987 | United Kingdom . |
| 2207633 | 2/1989 | United Kingdom . |
| 8604018 | 7/1986 | WIPO . |

OTHER PUBLICATIONS

"FIREC® Fire–Resistant Coatings: Typical Properties, Chemical Resistance, Fire and Environmental Tests", ICI Specialty Chemicals, Technical Bulletin 150–3E (Undated).

"FIREC® Total System–The World's Foremost Epoxy Composite Lightweight Fire Resisting Intumescent Coatings" Advanced Fireproofing Systems, Ltd., Product Bulletin (Undated).

"FIREC®–The World's Foremost Weatherproofing Lightweight Epoxy Fire Resisting Intumescent Coatings" Advanced Fireproofing Systems, Ltd. Bulletin (Undated).

Ellard, James A., "Performance of Intumescent Fire Barriers" *American Chemical Society*—Division of Organic Coatings 165th Meeting, Dallas, TX. (Apr. 8–13, 1973).

*Fig. 1.*
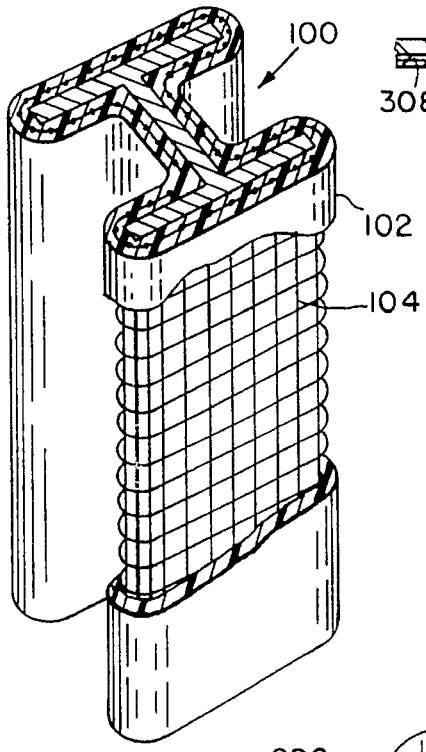
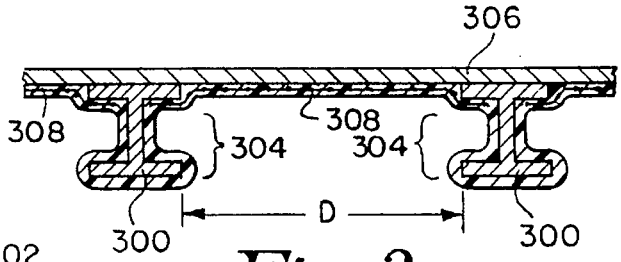
*Fig. 3.*
*Fig. 2.*
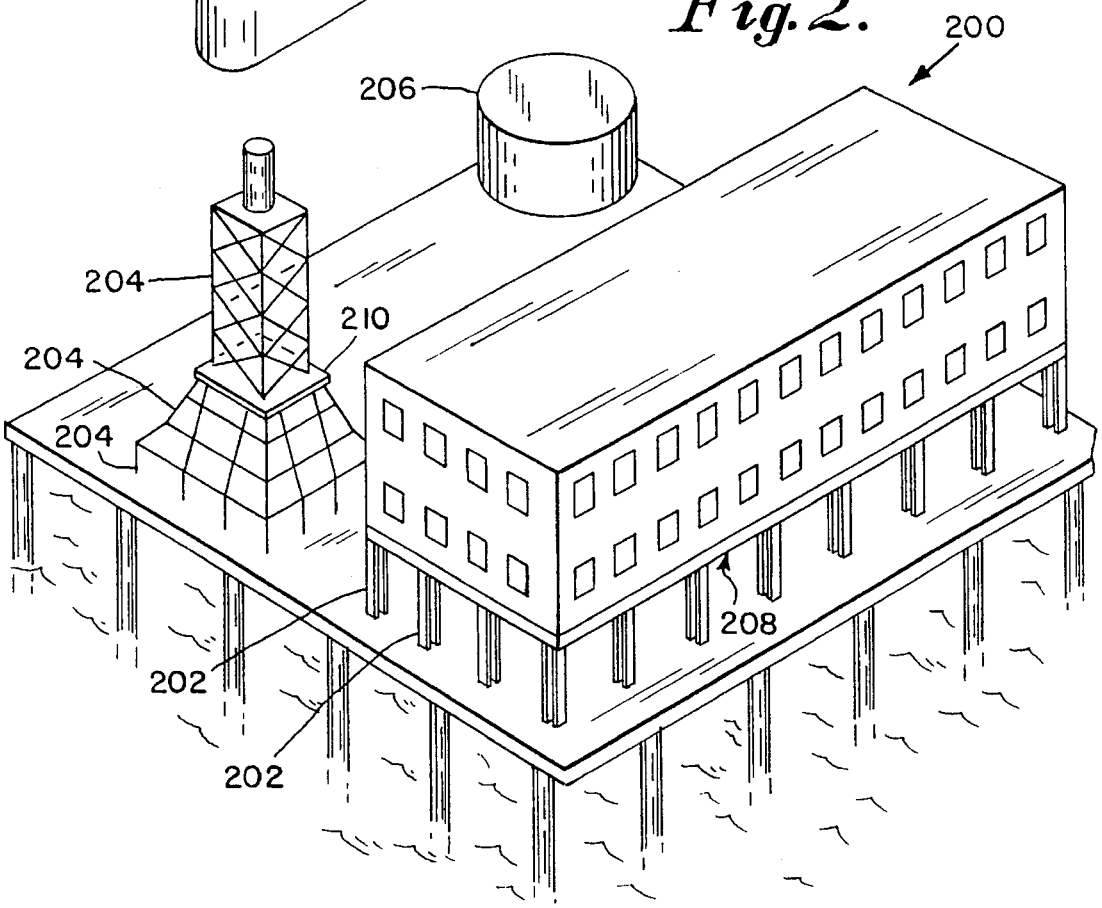

REINFORCEMENT SYSTEM FOR MASTIC INTUMESCENT FIRE PROTECTION COATINGS

This is a continuation of application Ser. No. 07/983,877 filed on Dec. 1, 1992, now abandoned.

This invention relates generally to mastic fire protection coatings and more particularly to reinforcement systems for such coatings.

Mastic fire protection coatings are used to protect structures from fire. One widespread use is in hydrocarbon processing facilities, such as chemical plants, offshore oil and gas platforms and refineries. Such coatings are also used around hydrocarbon storage facilities such as LPG (liquified petroleum gas) tanks.

The coating is often applied to structural steel elements and acts as an insulating layer. In a fire, the coating retards the temperature rise in the steel to give extra time for the fire to be extinguished or the structure evacuated. Otherwise, the steel might rapidly heat and collapse.

Mastic coatings are made with a binder such as epoxy or vinyl. Various additives are included in the binder to give the coating the desired fire protective properties. The binder adheres to the steel.

One particularly useful class of mastic fire protective coatings is termed "intumescent". Intumescent coatings swell up when exposed to the heat of a fire and convert to a foam-like char. The foam-like char has a low thermal conductivity and insulates the substrate. Intumescent coatings are sometimes also called "ablative" or "subliming" coatings, Though the mastic coatings adhere well to most substrates, it is known to embed mesh in the coatings. The mesh is mechanically attached to the substrate. U.S. Pat. Nos. 3,913,290 and 4,069,075 to Castle et al. describe the use of mesh. In those patents, the mesh is described as reinforcing the char once it forms in a fire. More specifically, the mesh reduces the chance that the coating will crack or "fissure". When fissures in the material do occur, they are not as deep when mesh is used. As a result, the mastic does not need to be applied as thickly. Glass cloth has also been used to reinforce fire protective mastics. U.S. Pat. No. 3,915,777 describes such a system. Glass, however, melts at temperatures to which the coating might be exposed. Once the glass melts, it provides no benefits.

The mesh also provides an additional advantage before there is a fire. Mastics are often applied to steel substrates and are often applied where the coating is exposed to harsh environmental conditions including large temperature swings of as much as 120° F. Such temperature swings can cause the mastic to debond from the substrate. However, the mesh will reduce debonding.

Debonding occurs as a result of temperature swings because of the difference in the coefficient of thermal expansion between the coating and the substrate. When the temperature changes, the coating and the substrate expand or contract by different amounts. This difference in expansion or contraction stresses the bond between the coating and the substrate. Even though the mastic coating is somewhat flexible, sufficient stress can break the bond between the coating and the substrate.

However, mesh embedded in the coating makes the coefficient of thermal expansion of the coating much closer to the coefficient of thermal expansion of the substrate. As a result, less stress occurs and debonding is much less likely.

Use of mesh in conjunction with mastic coatings has been criticized because it increases the cost of applying the material. It would be desirable to obtain the benefits of mechanically attached wire mesh without as much added cost.

It has been suggested that woven carbon fibers be used instead of metal mesh, but no details of such a system have been disclosed.

SUMMARY OF THE INVENTION

With the foregoing background in mind, it is an object to provide a fire protection coating system with low installation cost, good fire protection and resistance to temperature cycling.

The foregoing and other objects are achieved with a mesh made of non-melting, non-flammable, flexible yarn.

In one embodiment, the coating is a flexibilized coating.

In another embodiment, the coating is less than 10 mm thick.

In yet a further embodiment, the coating with embedded yarn is applied to portions of a structure smaller than 3 meters square and a coating with a reinforcing mesh mechanically attached to the substrate is applied to surfaces larger than 3 meters square.

BRIEF DESCRIPTION OF THE DRAWINGS

The invention will be better understood by reference to the following more detailed description and accompanying drawings in which:

FIG. 1 shows a coating with yarn mesh embedded in it; and

FIG. 2 shows a facility with mastic fire protective coating applied to it;

FIG. 3 shows in cross section a mastic fire protective coating applied on an undersurface;

DESCRIPTION OF THE PREFERRED EMBODIMENT

Figure 4:
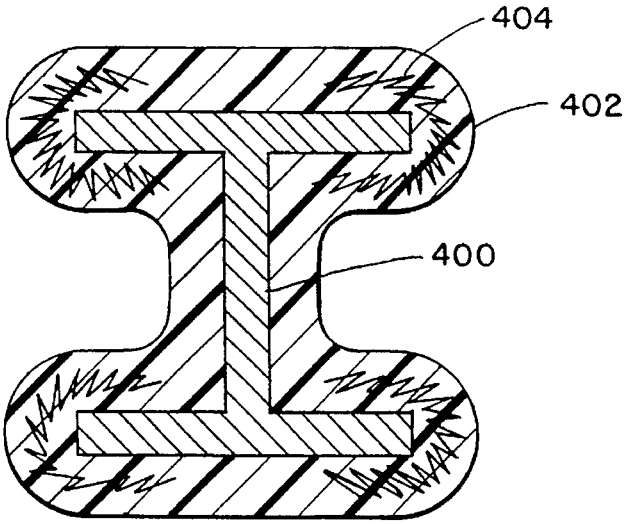
FIG. 4 shows in cross section an I-beam with a flexible mesh embedded in mastic fire protective coating.

FIG. 1 shows a column 100 such as might be used for structural steel in a hydrocarbon facility. A column is illustrated. However, the invention applies to beams, joists, tubes or other types of structural members or other surfaces which need to be protected from fire. Coating 102 is applied to the exposed surfaces of column 100. Coating 102 is a known mastic intumescent fire protection coating. Chartek® coating available from Textron Specialty Materials in Lowell, MA USA is an example of one of many suitable coatings.

Coating 102 has a carbon mesh 104 embedded in it. Carbon mesh 104 is made from a flexible, noninflammable material which maintains its structural strength at temperatures in excess of 900° F. Carbon yarn and carbon yarn precursor materials are suited for this purpose. As used hereinafter, mesh made with either carbon yarn or carbon yarn precursor is termed "carbon mesh". Such yarns offer the advantage of being light and flexible in comparison to welded wire mesh. However, they do not burn, melt or corrode and withstand many environmental effects.

Carbon yarns are generally made from either PAN (poly acrylic nitride) fiber or pitch fiber. The PAN or pitch is then slowly heated in the presence of oxygen to a relatively low temperature, around 450° F. This slow heating process produces what is termed an "oxidized fiber". Whereas the PAN and pitch fibers are relatively flammable and lose their strength relatively quickly at elevated temperatures, the oxidized fiber is relatively nonflammable and is relatively inert at temperatures up to 300° F. At higher temperatures, the oxidized fiber may lose weight, but is acceptable for use in fire protective coatings as it does not lose carbon content. Oxidized fiber is preferably at least 60% carbon.

Carbon fiber is made from the oxidized fiber by a second heat treating cycle according to known manufacturing techniques. This second heat treating step will not be necessary in some cases since equivalent heat treatment may occur in a fire. After heat treating, the fiber contains preferably in excess of 95% carbon, more preferably in excess of 99%. The carbon fiber is lighter, stronger and more resistant to heat or flame than the precursor materials. The carbon is, however, more expensive due to the added processing required. Carbon fiber loses only about 1% of its weight per hour at 600° C. in air. Embedded in a fire protection coating, it will degrade even less.

Carbon mesh 104 preferably has an opening below 1", more preferably, less than ½" and most preferably between 1/16" and ¼" to provide adequate strength but to allow proper incorporation into coating 102 and to allow proper intumescence of coating 102 in a fire. This spacing also reduces fissuring of coating 102 as it intumesces.

The carbon yarn used should provide a fabric with a weight preferably between 0.04 lb/yd$^2$ and 0.50 lb/yd$^2$. More preferably, a weight of between 0.07 and 0.12 lb/yd$^2$ is desirable. If oxidized fiber is used, the weights will be higher, preferably, between 0.08 lb/yd$^2$ and 1 lb/yd$^2$ and more preferably, between 0.14 and 0.25 lb/yd$^2$.

Various types of yarn could be used. Preferably, a multiply yarn is used. Between 2 and 5 plies is desirable.

The yarn is flexible and can be converted to a mesh by known techniques. A plain weave, satin weave or basket weave might be used. These weaves can be made in high volumes on commercial textile equipment. More specialized mesh can be made by such techniques as triaxial weaving. While more expensive, the resulting mesh is more resistant to bursting and has a more isotropic strength. The mesh might also be produced by braiding or knitting.

Column 100 is coated according to the following procedure. First, a layer of mastic intumescent coating is applied to column 100. The mastic intumescent may be applied by spraying, troweling or other convenient method. Before the coating cures, the carbon mesh 104 is rolled out over the surface. It is desirable that mesh 104 be wrapped as one continuous sheet around as many edges of beam 100 as possible. Cloth 104 is pressed into the coating with a trowel or roller dipped in a solvent or by some other convenient means.

Thereafter, more mastic intumescent material is applied. Coating 102 is then finished as a conventional coating. The carbon mesh is thus "free floating" because it is not directly mechanically attached to the substrate.

Reinforcement such as carbon mesh 104 is desirable for use on edges where fissuring is most likely to occur. It is also desirable for use on medium sized surfaces at coating thicknesses up to about 14 mm. Medium sized surfaces are unbroken surfaces having at least one dimension between 6 inches and about 3 feet.

For larger surfaces, carbon cloth can still be used. However, we have found that when surfaces are coated with a mastic intumescent and then exposed to temperature variations or exposed to a fire, the stress within the coating increases in proportion to the size of the area coated. These stresses can cause cracking and allow the coating to fall off the substrate. As a result, it may be desirable to mechanically attach the reinforcement to the substrate when large surfaces are coated. For example, pins might be welded to the substrate prior to coating with the mastic intumescent. After the carbon mesh is applied, the pins might then be bent over the carbon mesh to hold it in place. Alternatively, metal clips might be slipped over the edges of the substrate to hold the carbon mesh to the substrate at the edges. Wire mesh as conventionally used could be used for these large surfaces.

We have also found similar increases in internal stress for coatings thicker than about 14 mm. For such thick coatings, the stresses caused by slow thermal expansion and contraction are more problematic than stresses occurring in a fire. The flexible carbon mesh as described herein is not as useful at counteracting the stresses caused by thermal expansion as welded wire mesh as conventionally used.

Flexibilized epoxy mastic intumescent coatings have been suggested to avoid debonding with temperature cycling. For example, U.S. Pat. Nos. 5,108,832 and 5,070,119 describe such coatings. Using such flexibilized epoxy mastic intumescents tend to decrease the impact of temperature cycling. As a result, slightly thicker coatings can be used with the flexibilized epoxy mastic intumescents, up to about 17 mm thick.

As a result, it may be desirable to use a variety of reinforcement means at various points in a facility. For example, small surfaces might be coated with mastic intumescent without reinforcement. Medium sized surfaces and edges might be coated with mastic intumescent reinforced with a free floating carbon cloth. Larger surfaces might be reinforced with an anchored mesh. Areas coated to thicknesses greater than 14 mm might be reinforced with a rigid welded metal mesh.

FIG. 2 shows schematically an offshore hydrocarbon processing facility 200. Facility 200 contains structures supported by beams and columns such as columns 202 and 204. Such beams and columns come in sizes which are termed herein small and medium. Facility 200 also contains surfaces which are described herein as being large. For example, the exterior of tank 206, the underside of building 208 and platform 210 contain many large surfaces. The application technique most suitable to each of these types of surfaces might be employed.

FIG. 3 shows in more detail the underside of floor or deck 306 supported by beams 300. The span D between beams 300 represents a large surface which might be beneficially reinforced with a mesh mechanically attached to deck 306. Regions 304 on beams 300 are small or medium sized surfaces and might be reinforced with carbon mesh. However, it is desirable to have rigid wire mesh 308 extend over the flanges of beams 300 where they contact deck 306. Otherwise, in a fire, coating 302 might tend to pull away from the top portion of beams 300.

On other surfaces where the long dimension of the mesh runs vertically, mastic intumescent reinforced with free floating carbon mesh might also tend to pull away from the surface. In those instances, clips, pins or other attachment means could be used selectively at the edges of those surfaces.

Turning now to FIG. 4, another advantage of using a flexible reinforcement is illustrated. FIG. 4 shows a cross section of an I-beam 400 coated with a mastic intumescent fire protective coating 402. Coating 402 at the edges of I-beam 400 is reinforced by carbon mesh 404. Here, carbon mesh 404 is pleated when applied. As the fire protective coating 402 expands in a fire, carbon mesh 404 also expands as the pleats unfold. In this way, carbon mesh 404 will reinforce the outer portions of the char. The outer portions of the char are thus less likely to crack or fall off in a fire. Longer protection in a fire can therefore be obtained by using a free floating, expandable carbon mesh embedded in the outer half of the fire protective coating at the edges. Preferably, the expandable mesh is in the outer third of the material.

Figure 5A:
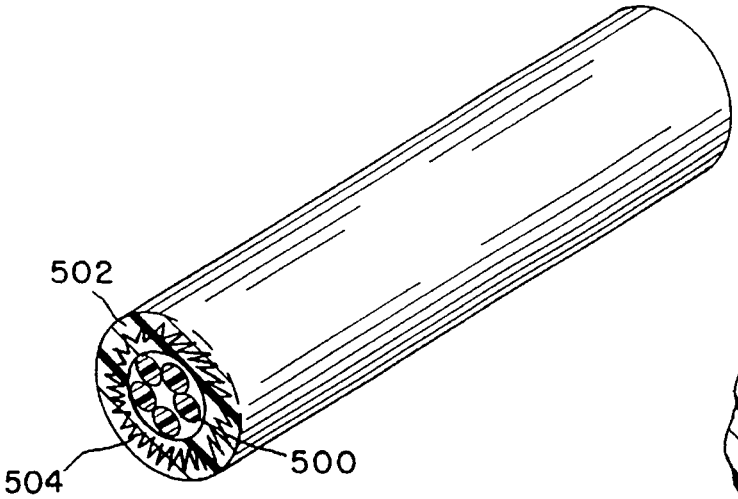
FIG. 5A shows a sketch of a cable bundle with a flexible mesh embedded in mastic fire protective coating.
Figure 5B:
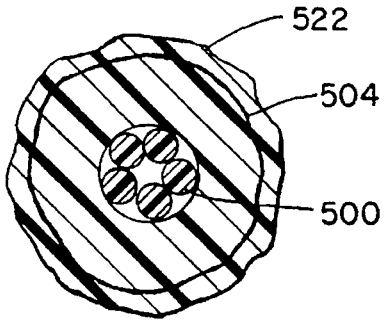
FIG. 5B shows in cross section the cable bundle of FIG. 5A after exposure to fire.

Using an expandable mesh with other surfaces having a small radius of curvature is also beneficial. Use of an expandable mesh on tubes and other surfaces having a radius of curvature below approximately 12 inches is desirable. FIG. 5A shows an expandable carbon mesh 504 in the intumescent coating 502 on a cable bundle 500. When the coating on a round structure, such as cable bundle 500, intumesces, the circumference of the expanded coating is greater than the circumference of the unexpanded coating. Using pleated carbon mesh 504 allows the mesh to expand with the coating as shown in FIG. 5B. Reinforcement to the outer portions of the char 522 is thus provided.

A drawback of using rigid mesh in the outer portion of an intumescent coating is that the rigid mesh restrains intumescence. In a fire, then, the coating is less effective as an insulator. Using an expandable mesh restrains intumescence to a much smaller degree. The net result is less fissuring with good intumescence, which leads to better fire protection.

FIGS. 4 and 5A show an expandable carbon mesh made by pleating the carbon mesh. The pleats could be made by folding the carbon mesh as it is applied. Alternatively, a knit carbon mesh could be used as knit materials inherently have "give" so that they will expand. A warp or jersey knit is well suited for this application.

Figure 6:
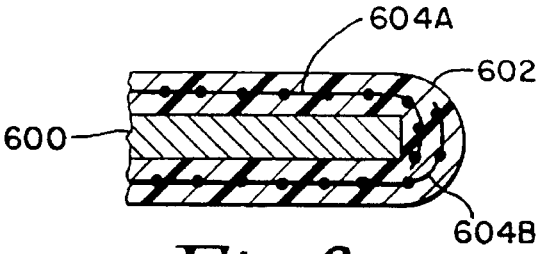
FIG. 6 shows in cross section an edge with expandable mesh.

FIG. 6 shows an alternative way to make an expandable mesh. A substrate edge 600, having a radius of curvature less than 1 inch, is coated with an intumescent coating 602. Embedded within coating 602 are two sheets of carbon mesh, 604A and 604B. Sheets 604A and 604B overlap at the edge. As coating 602 intumesces, sheets 604A and 604B will pull apart, thereby allowing intumescence.

Using an expandable mesh as described is beneficial even if a lower temperature material is used to form the mesh. For example, glass fibers as conventionally used for reinforcement might be made expandable. All the benefits of using a non-flammable, non-melting, flexible carbon mesh would not, however, be obtained.

Having described the invention, it will be apparent that other embodiments might be constructed. For example, use of carbon mesh was described. Similar results might be obtained by using non-welded, woven or knitted metal wire mesh. Stainless steel, carbon steel, copper or similar wire could be used to make the flexible wire mesh. Small diameter wire must be used to allow flexibility. Preferably, the wire is smaller than 25 gauge and more preferably below 30 gauge. A non-welded construction is also preferable as it allows flexibility. For example, woven wire mesh as is commercially available to make conveyor belts and the like is suitable for use. However, the metal mesh is heavier than carbon mesh and not as desirable for weight sensitive applications. Also, mesh made from ceramic yarn in place of carbon could be used to provide a flexible mesh. Though more costly than carbon mesh, a mesh made from REFRA-SIL® (a trademark of the Carborundum Company for silica fibers) fibers could be used equally well.

What is claimed is:

1. A fire retardant coating system for retarding the effects of fire on the structural elements of a hydrocarbon processing facility comprising:

a. a substrate consisting of the outer surface of the structural element;

b. a first layer of an intumescent mastic material applied to the substrate;

c. a second layer of a carbon mesh material applied over the first layer without mechanical connection to the substrate, having a carbon content in excess of sixty percent to a weight in the range of 0.07 and 0.012 pounds per square yard, and further said material capable of maintaining its structural integrity at temperatures in excess of 900 degrees F., said mesh constructed with openings in the range of 1/16 to ½ inches; and d. a third layer of the intumescent mastic material applied over the carbon mesh to fill the openings of the mesh and form a system in which the carbon mesh is imbedded in the mastic to provide structure to the coating system while allowing movement of the intumescent mastic as it expands to form a char when exposed to heat.

2. A fire retardant coating system for retarding the effects of fire on the structural elements of a hydrocarbon processing facility as described in claim 1 wherein the carbon mesh has a carbon content in excess of ninety five percent and a weight in the range of 0.14 and 0.25 pounds per square yard.

3. A fire retardant coating system for retarding the effects of fire on the structural elements of a hydrocarbon processing facility as described in claim 1 wherein the carbon mesh layer is pleated to provide a greater flexibility during expansion of the intumescent material to form a char when exposed to heat.

* * * * *

UNITED STATES PATENT AND TRADEMARK OFFICE

CERTIFICATE OF CORRECTION

PATENT NO. : 5,580,648

DATED : December 3, 1996

INVENTOR(S) : George K. Castle and John J. Gaffney

It is certified that error appears in the above-identified patent and that said Letters Patent is hereby corrected as shown below:

Claim 1, line 11, after percent change "to" to --and--.
Claim 1, line 11, that portion of the claim reading "0.07 and 0.012" should read ---0.07 to 0.12---.

Claim 2, line 5, that portion of the claim reading "0.14 and 0.25" should read ---0.14 to 0.25---.

Signed and Sealed this

Eleventh Day of November, 1997

*Attest:*

*Attesting Officer*

Bruce Lehman

BRUCE LEHMAN

*Commissioner of Patents and Trademarks*